US009833801B2

(12) United States Patent
Noel et al.

(10) Patent No.: US 9,833,801 B2
(45) Date of Patent: Dec. 5, 2017

(54) DISPENSER FOR VISCOUS PRODUCTS

(71) Applicant: CHANEL PARFUMS BEAUTE, Neuilly sur Seine (FR)

(72) Inventors: Claire Noel, Paris (FR); Alain Cambon, Naucelles (FR); Frédéric Jouan, Bonneval (FR)

(73) Assignee: Chanel Parfums Beaute, Neuilly sur Seine (FR)

( * ) Notice: Subject to any disclaimer, the term of this patent is extended or adjusted under 35 U.S.C. 154(b) by 0 days.

(21) Appl. No.: 14/404,862

(22) PCT Filed: May 28, 2013

(86) PCT No.: PCT/FR2013/051177

§ 371 (c)(1),
(2) Date: Dec. 1, 2014

(87) PCT Pub. No.: WO2013/178927

PCT Pub. Date: Dec. 5, 2013

(65) Prior Publication Data

US 2015/0144663 A1 May 28, 2015

(30) Foreign Application Priority Data

Jun. 1, 2012 (FR) ..... 12 55127

(51) Int. Cl.
*B05B 11/00* (2006.01)
*A45D 34/00* (2006.01)
(Continued)

(52) U.S. Cl.
CPC ..... *B05B 11/3047* (2013.01); *A45D 34/00* (2013.01); *B05B 11/3001* (2013.01);
(Continued)

(58) Field of Classification Search
CPC ..... B05B 11/3047; B05B 11/3052; B05B 11/3001; A45D 34/00; B65D 47/18; B01L 3/021; B01L 3/0289; B01L 3/0293
(Continued)

(56) References Cited

U.S. PATENT DOCUMENTS 9,078,507 B2 * 7/2015 Lee ..... A45D 34/00
2005/0072808 A1 * 4/2005 Kitamura ..... B05B 11/3008 222/309
(Continued)

FOREIGN PATENT DOCUMENTS

JP 07022958 U 4/1995
KR 20110133700 A 12/2011
(Continued)

OTHER PUBLICATIONS

Oct. 2, 2013 Written Opinion issued in International Application No. PCT/FR2013/051177.
(Continued)

*Primary Examiner* — Paul R Durand
*Assistant Examiner* — Andrew P Bainbridge
(74) *Attorney, Agent, or Firm* — Harness, Dickey & Pierce, P.L.C.

(57) ABSTRACT

A dispenser for viscous products, including: a container for a product, a sealing cap designed to be screwed onto the container, a pipette, and a piston capable of causing a suction of the product into the pipette, the dispenser being arranged such that, when the cap is screwed onto the container, the unscrewing of the cap in the direction of opening of the dispenser causes, by itself, a movement of the piston producing the suction.

20 Claims, 3 Drawing Sheets

(51) Int. Cl.
*B65D 47/18* (2006.01)
*B01L 3/02* (2006.01)

(52) U.S. Cl.
CPC ..... *B05B 11/3052* (2013.01); *B65D 47/18* (2013.01); *A45D 2200/055* (2013.01); *B01L 3/0289* (2013.01); *B01L 3/0293* (2013.01)

(58) Field of Classification Search
USPC ..... 222/383.1, 282–288, 309–314, 339, 390, 222/420–422, 152, 212–215, 405, 222/519–525, 464.1–464.7; 141/83, 113; 73/864.11, 864.25; 422/919–934
See application file for complete search history.

(56) References Cited

U.S. PATENT DOCUMENTS

2012/0261029 A1* 10/2012 Kim ..... A45D 34/04 141/23
2013/0032242 A1* 2/2013 Beranger ..... A45D 34/04 141/23
2014/0020789 A1* 1/2014 Duquet ..... A45D 34/04 141/24
2015/0144663 A1* 5/2015 Noel ..... A45D 34/00 222/383.1
2015/0257510 A1* 9/2015 Kim ..... A45D 34/041 401/126
2016/0058154 A1* 3/2016 Jung ..... A45D 34/04 222/382

FOREIGN PATENT DOCUMENTS

KR 20120014653 A 2/2012
WO 2012136938 A1 10/2012

OTHER PUBLICATIONS

Oct. 2, 2013 Search Report issued in International Application No. PCT/FR2013/051177.

* cited by examiner

DISPENSER FOR VISCOUS PRODUCTS

The invention relates to members for dispensing products, in particular in the form of a gel, lotion, cream or liquid, in the field of care or makeup products.

A dispenser provided with a reservoir and a pipette fixed to a cap which has a push button for dispensing the product is known. A spring or an elastically deformable diaphragm allows product to be sucked into the pipette.

The dispensing of a precise dose of viscous product, for example in a dropwise manner, by means of such a device raises difficulties. Specifically, upon use, when the user releases the push button after having discharged the product contained in the pipette, the elastic suction system decompresses and sucks in air. It is in this configuration that the cap with the push button and the pipette is replaced on the reservoir. If the user then wishes to fill the pipette with product again, he will want to press the push button in order to drive the air out of the pipette and replace it with product. However, on account of the presence of a viscous product, this action is ineffectual, in particular because of the fact that the air bubble driven out of the pipette remains under the surface of the product in the reservoir and is then sucked back into the pipette.

There is thus a desire to improve the effectiveness and precision in the dispensing of viscous products.

In the document JP22958, when the cap of the dispenser is opened, the pipette sucks in liquid by virtue of the piston rising under the action of a spring. However, the suction force is limited by the force of the spring, and in the case of a product with a high viscosity, the spring cannot suck up the product. Another drawback is that a large number of components are required to produce such a system. These components complicate the assembly of the dispenser and increase the overall production costs.

It is an aim of the invention to provide a dispenser that allows precise dispensing of the product and is easier to produce.

To this end, a subject of the invention is in particular a product dispenser which comprises:

- a reservoir for a product,
- a closure cap intended to be screwed onto the reservoir, and
- a piston able to bring about suction of the product,
- the dispenser being designed such that, when the cap is screwed on the reservoir, a rotation of the cap with respect to the reservoir in the direction of opening of the dispenser causes, by itself, the piston to move along a path producing the suction.

In a conventional manner, a dispenser with a screwed cap is opened by the cap being rotated in the counterclockwise direction.

Thus, the rotation of the cap forces the piston to rise by being mechanically driven even while the dispenser is not yet open and the pipette is still dipped in the product. This rising allows the pipette to be filled with product without the intrusion of an air bubble. The dispenser thus makes it possible to dispense precise doses of product, even if the latter is viscous. In addition, the rotation suffices to move the piston with respect to the pipette. Rising takes place without it being necessary to provide a spring. The mechanism housed in the cap is simplified, the number of components is reduced, the manufacturing of the dispenser is less expensive and the assembly thereof is more rapid.

Advantageously, the dispenser is designed such that the rotation of the cap in the direction of opening causes a push button to emerge from the cap.

Advantageously, the dispenser is designed such that the rotation of the cap in the direction of opening causes the push button to move before the cap is unscrewed from the reservoir.

Thus, the piston is made to rise before the dispenser is opened so as to again avoid the intrusion of an air bubble into the pipette.

Advantageously, the dispenser is designed such that, at the end of the movement travel of the push button, the rotation of the cap causes the latter to be unscrewed without the piston moving with respect to the cap.

Thus, the movement of the piston precedes unscrewing without requiring any intermediate action between these two steps. The unscrewing of the cap occurs in continuation of the rotation which has caused the movement of the piston. The two operations can thus take place by means of the same hand movement on the part of the user.

Preferably, the dispenser is designed such that, after the push button has been placed in an at least partially depressed position with respect to the cap during an operation of dispensing the product, the dispenser does not produce any force that tends to cause said push button to leave said position until the cap is replaced on the reservoir.

Thus, keeping the push button in this position ensures that the dispenser does not suck in air following the dispensing operation.

Preferably, the dispenser is designed such that, after the push button has been placed in an at least partially depressed position with respect to the cap during an operation of dispensing the product, the dispenser does not produce any force that tends to cause said push button to leave said position until unscrewing is carried out.

Thus, the pipette does not fill with air between the time at which the dose of product has been dispensed and the time at which the user reopens the cap.

Advantageously, the dispenser is designed such that, after the push button has been placed in an at least partially depressed position with respect to the cap during an operation of dispensing the product, the rotation of the cap in the direction of opening returns the piston to the end of its path.

Thus, the user can dispense a maximum dose of product while the push button is in a partially depressed position following the dispensing of a partial dose of product.

Advantageously, the dispenser comprises at least one ramp and at least one cam, the cap moving the piston by means of said ramp and cam.

This is an example of a mechanism which makes it possible to dispense with the use of a return spring.

It is possible to provide for the ramp and the cam of the dispenser to be secured to the cap and the piston, respectively.

Advantageously, the dispenser comprises a sleeve having a thread for screwing the cap onto the reservoir and a slot that receives the cam.

It is possible to provide for the dispenser to comprise at least one stop for the cam that is able to connect the ramp and the cam in rotation.

For example, the product has a viscosity of between 10 000 and 35 000 centipoise, preferably between 16 000 and 28 000 centipoise (viscosity measured with the aid of a Brookfield LVT viscometer equipped with a spindle 3 and rotating at a speed of three rotations per minute).

A further subject of the invention is a closure cap for a product reservoir, which comprises:

a screwing insert, a sleeve, and a piston, the cap being designed such that a rotation of the screwing insert with respect to the sleeve causes, by itself, the piston to move.

A further subject of the invention is a makeup or care device comprising a dispenser and/or a cap according to the invention, the device comprising a makeup and/or care product.

Further features and advantages of the invention will become further apparent from the following description of an embodiment given by way of nonlimiting example with reference to the appended drawings, in which.

Figure 1:
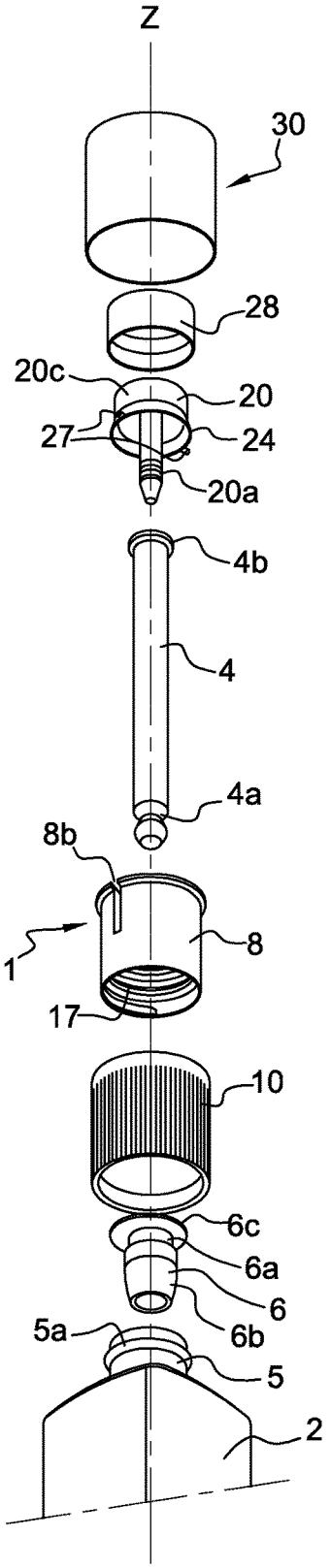
FIG. 1 is an exploded perspective view of the dispenser.
Figure 2:
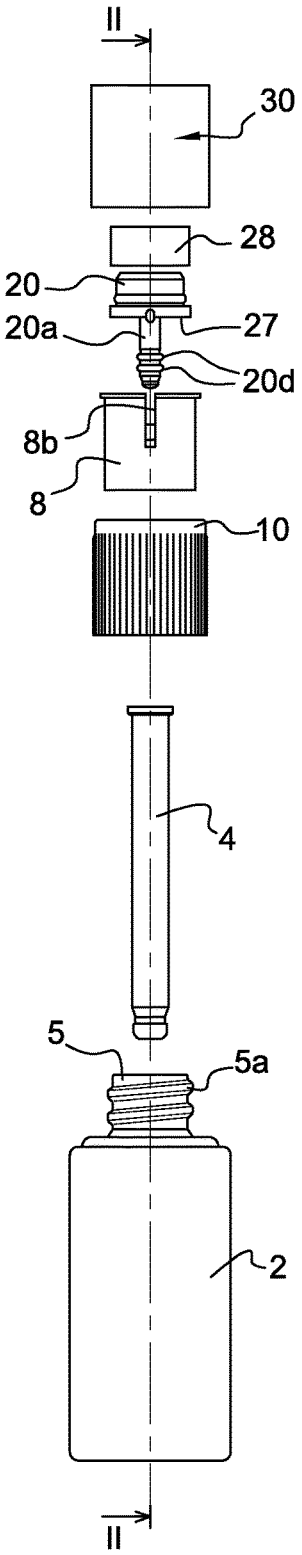
FIG. 2 is an exploded front view of the dispenser from FIG. 1.
Figure 3:
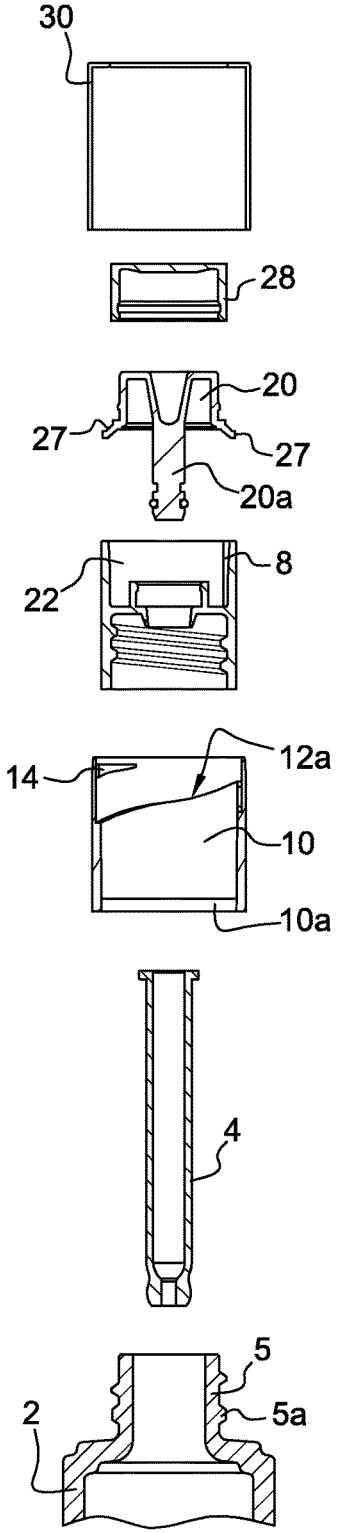
FIG. 3 is a sectional view of the dispenser on the plane II-II in FIG. 2.
Figure 4:
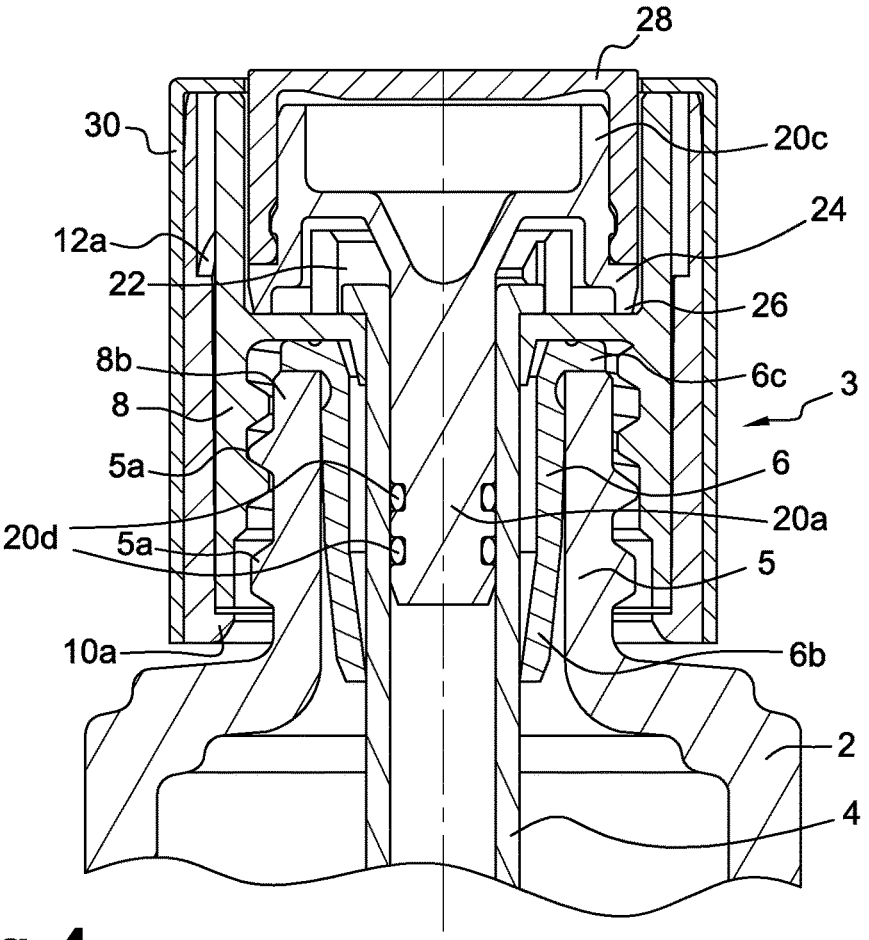
FIG. 4 is a partial view in axial section of the dispenser from FIG. 1.

With reference to the figures, in the present embodiment of the invention, the dispenser 1 comprises a reservoir 2 (or bottle) on which a cap 3 is screwed. The reservoir comprises a makeup or care product which is for example a viscous product, the viscosity of which is between 10 000 and 35 000 centipoise, preferably between 16 000 and 28 000 centipoise. The reservoir 2 defines a volume for storing the product. Its section is square (but may also have other shapes) and it has an outlet orifice at the end of a neck 5 made in one piece with the reservoir 2.

The dispenser and most of its components have an overall shape which is rotationally symmetrical about an axis Z of the dispenser.

The cap 3 is composed of various coaxial components, in this case an outer cover 30, a push button 28, a piston 20, a sleeve 10, a screwing insert 8 and a pipette 4 which makes it possible to remove the product contained in the reservoir 2.

A wiper 6 with a substantially tubular shape is housed inside the neck 5. The wiper 6 has a top part 6*a* which has a cylindrical shape, a bottom part 6*b* which is substantially frustoconical and a shoulder 6*c* at one end of its top part 6*a* which serves to bear against the top of the neck 5 so as to close the reservoir in a sealed manner when the cap is screwed on. The role of the wiper 6 is to remove excess product which naturally adheres to the outer surface of the pipette 4. Further constructions of the wiper may also be suitable. The wiper is furthermore optional.

A cylindrical screwing insert 8 having a circular section is housed inside the volume defined by the cap 3. It comprises threads 8*d* on its inner face that are able to engage with threads 5*a* on the outer face of the neck 5. Thus, the screwing insert 8 allows the cap 3 to be screwed onto the neck 5 in order to close off the reservoir by means of the cap. Preferably, the thread 5*a* is terminated by an end-of-screwing stop. This stop, which is for example a local deformation of the thread, forms a hard point for the end of screwing of the cap.

Two diametrically opposed rectilinear through-slots 8*b* that are parallel to the axis Z extend through the wall of the screwing insert 8 over the upper half of its height.

Figure 5:
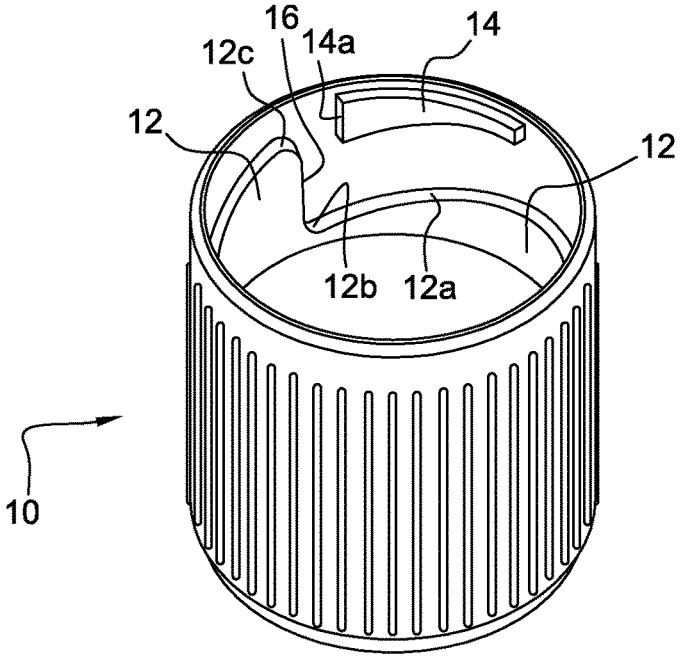
FIG. 5 is a perspective view of a sleeve of the dispenser from FIG. 1.

A sleeve 10 that in this case forms a cylindrical translational insert covers the screwing insert 8, the screwing insert being kept in vertical position on the sleeve by a stop 10*a* in the axial direction. Further constructions may also be suitable. As shown in FIG. 5, the sleeve 10 has an inner face that has two ramps 12, two end-of-travel stops 14 and two repositioning stops 16. These ramps and these stops form surfaces that have a generatrix oriented in a radial direction with respect to the axis Z.

On the inner face of the sleeve 10, the ramps 12 have a helical shape of axis Z and form a shoulder directed toward the upper edge of the sleeve 10. They form inclined bearing surfaces 12*a* which are delimited by a ramp foot 12*b* and a ramp top 12*c*. The foot of one of the ramps extends substantially vertically below the top of the other and vice versa, each ramp extending about a half-turn. The two ramps are identical to one another by rotation through a half-turn about the axis Z.

The repositioning stops 16 form rectilinear reliefs that are parallel to the axis. They extend from the top 12*c* of one of the two ramps to the foot 12*b* of the other ramp.

The end-of-travel stops 14 form reliefs that extend in radial projection from the inner surface of the sleeve 10 and are isolated from the ramps and the other stops 16. They extend opposite respective ramps in the axial direction. They have vertical surfaces 14*a* which are parallel to the repositioning stops 16 and are located at the level of the tops 12*c* of the ramps 12. The spacing between the stops 16 and the opposite vertical surfaces 14*a* is sufficient to allow the free passage of a stud 27.

The pipette 4 has an elongate body with a tubular shape and its lower end forms a reduction in section 4*a* which makes it possible to pass easily through the wiper 6 and to retain the liquid in the pipette when the latter is out of the dispenser 1. The upper end of the pipette forms a shoulder 4*b* which is able to bear axially against a bearing surface of the screwing insert 8 when the pipette is mounted in the cap 3.

A piston 20 is housed in a hollow upper part 22 of the screwing insert 8. It has a rod 20*a*, the lower end of which is inserted into the upper end of the pipette. The rod 20*a* can move relative to the pipette along a predetermined path. Sealing between the rod 20*a* and the pipette is realized by any appropriate means and for example by one or two O-ring seals 20*d*. The top of the piston 20*c* has a rotationally symmetrical shape and comprises a lip 24 that bears radially against the inner face of the screwing insert 8. The piston 20 comprises two cams that are formed in this case by two diametrically opposite radial studs 27 that project from the lip 24. The studs 27 are able to pass through the slots 8*b* in the screwing insert 8 and to come into abutment against the ramps 12 and the stops 14*a* and 16. The piston 20 is surmounted by a cylindrical push button 28 which moves together with the piston.

The cap 3 comprises an outer cover 30 with a hollow cylindrical shape which accommodates all of the abovementioned elements (from 4 to 28). The top of the cover 30 has an orifice that is able to let through the push button 28, which is able to move in translation with respect to the cover along the axis Z of the dispenser 1.

The cover 30 is fixed rigidly to the sleeve 10 for example by adhesive bonding. The piston 20 is connected securely to the push button 28. On account of the fact that the studs 27 pass through respective slots 8*b*, the piston 20 and the parts that are secured thereto are able to move by sliding with respect to the screwing insert 8 and to the parts to which they are secured, in the axial direction. The sleeve 10 is mounted so as to be able to rotate about the axis Z with respect to the screwing insert 8. It follows that the rotation of the sleeve 10 with respect to the screwing insert 8 makes it possible to slide the piston 20 and the parts that are secured thereto along the axis Z with respect to the sleeve 10 when the studs 27 travel along the respective ramps 12*a*. The path of the piston thus extends from a bottom position in which the push button is flush with the orifice in the outer cover 30 to a top position in which the push button projects from the cover. The path of the piston precisely determines the dose of product which is removed by the pipette. The volume of this dose depends on the shape of the ramp 12 and more specifically on the vertical distance which separates the foot of the ramp 12*b* and the top of the ramp 12*c*, and also on the inside diameter of the pipette. These two parameters can be varied in order to adjust the dose to the desired volume. The dose is also repeatable, that is to say that for each removal, the same dose of product is sucked up by the pipette, specifically the volume of the dose not being influenced by the manner in which the user manipulates the cap 3.

The friction point between the threads 5*a* of the bottle and 8*d* of the screwing insert is determined such that the unscrewing torque for overcoming this friction point is greater than the torque necessary to move the piston in translation during the suction of the product. Thus, upon unscrewing, the rotation of the sleeve 10 relative to the insert 8 takes place first of all, and then the insert and the sleeve are connected in rotation and are unscrewed together from the reservoir.

The operation of the device will now be presented. It is assumed that the dispenser 1 is filled with viscous product and that the cap 3 is closing off the reservoir 2.

With reference to FIG. 6A, the user turns the cover 30 in the unscrewing direction with respect to the reservoir 2. The sleeve 10 is driven in rotation, causing the studs 27 to slide along the ramps 12*a* and the slots 8*b*, the screwing insert 8 remaining fixed to the reservoir 2 at this stage. Driven in this way, the piston 20 moves in a similar manner and the rod 20*a* of the bottom of the piston 20 travels along its path inside the pipette 4, producing suction of the product. At the same time, and as shown in FIG. 6B, the push button 28 emerges from the top of the cover 30. Thus, when the studs 27 reach the top 12*c* of the ramps, the piston has reached the other end of its path, the push button 28 has reached an emerged position which forms the end of its travel, and the pipette 4 contains a dose of product.

When the user continues to rotate the cap in order to open the dispenser, the two studs 27 leave the ramps 12 and come into abutment against the vertical surfaces 14*a* of the end-of-travel stops 14, this having the effect of connecting the insert 8 and the sleeve 10 in rotation, and thus causing the screwing insert 8 to be unscrewed from the neck 5. Thus, the assembly formed by the cover 30, the push button 28, the piston 20, the screwing insert 8, the sleeve 10 and the pipette 4 moves in one piece in rotation about the axis. Therefore, in accordance with FIG. 6C, the cap 3 is unscrewed from the neck 5 along the threads 8*d*, the cap 3 being released from its screwed position and thereby allowing the user to remove the cap 3 and its pipette 4 from the dispenser 1.

Figure 6:
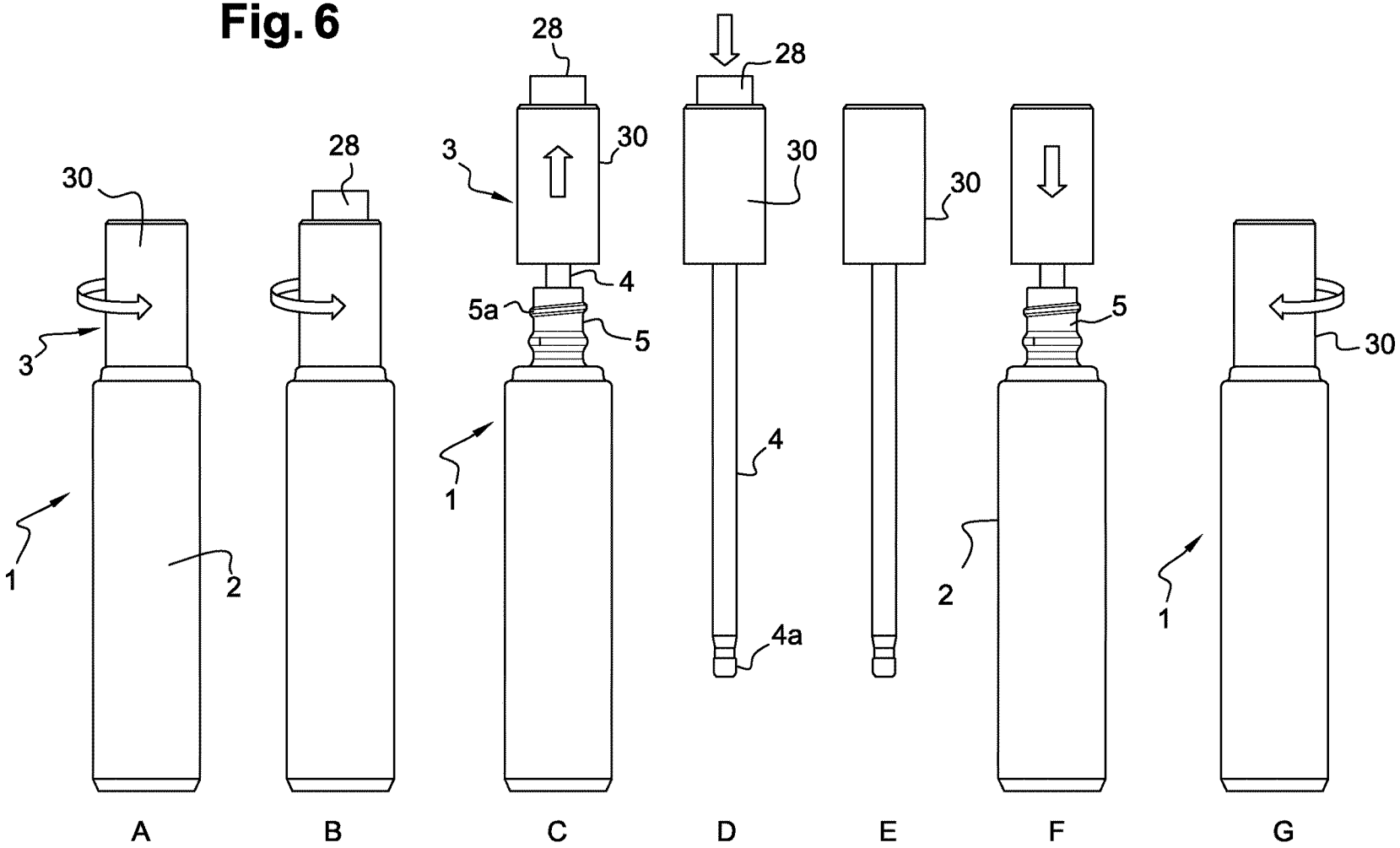
FIG. 6 shows successive steps of opening, dispensing the product and closing the dispenser from FIG. 1.

With reference to FIGS. 6D and 6E, in order to release the product contained in the pipette 4, the user presses the push button 28 with respect to the cover 30. The rod 20*a* of the piston moves back down in the pipette and causes the ejection of the product which was contained therein. When the user effects this dispensing of the product, he causes the studs 27 to lower, leaving the end-of-travel stops 14*a* in the direction of the ramp feet 12*b* which are located directly below, passing along the stops 16. It is assumed here that the user presses the push button 28 completely in order to administer a complete dose of product and thereby to place the push button and the piston 20 in the end-of-travel position. The push button 28 is thus in a depressed position and the piston 20 in a bottom position. This results in the situation in part E of FIG. 6. It will be noted here that no element of the dispenser thus spontaneously causes a movement of the push button. In particular the dispenser does not have any spring. The push button 28 thus remains in its depressed position, as illustrated in part E, until it is forced to leave this position.

In accordance with figures F and G, the user replaces the cap 3 and its pipette 4 on the dispenser 1 and screws the assembly back on until the dispenser 1 has been completely closed off. At this stage, the push button 28 and the piston 20 are still in the bottom position, at the bottom end of their travel. As before, this rotation then moves the assembly formed by the cover 30, the push button 28, the piston 20, the screwing insert 8, the sleeve 10 and the pipette 4 in one piece about the axis on the reservoir. In particular, the studs 27 are retained by the stops 16, thus causing the two inserts 8 and 10 to rotate as one in the direction of screwing the cap back on. The threads 8*d* of the screwing insert engage with those of the neck 5*d*, thereby allowing the cap to be screwed back on to the dispenser completely until it clears the friction point. The dispenser is then back in its initial position with the piston 20 still in the bottom position and the studs 27 positioned at the feet 12*b* of the ramps 12.

It is now assumed that, in part D of FIG. 6, the user only dispenses a partial dose of product and thus causes the push button 28 to move along only a part of its maximum travel. It is nevertheless assumed that this movement is sufficient for the studs 27 to be lower than the stop 14*a*. The push button 28 thus still protrudes slightly from the cover 30 and remains in this configuration until the dispenser is completely closed off, as illustrated in part G of FIG. 6. When the dispenser is used for the next time, the user turns the cover 30 once again with respect to the reservoir 2, as described above with reference to part A. This rotation of the sleeve with respect to the screwing insert has the effect of replacing the studs on the ramps but not at the foot thereof. The studs come into contact with the ramps in a median part thereof. They then travel along the remaining part of the ramps as far as the top of the ramp, as before. Under these conditions, the rotation of the cover has the effect of causing the push button to rise, and the piston together therewith, along a fraction of their path that corresponds to the partial dispensing effected. The studs 27 are thus brought into abutment at the end of their travel as illustrated in part B. The rest of the operation takes place as described above and the dispenser is ready for the user to be able to administer a complete dose or a partial dose of product, as desired. It will thus be seen that this dispenser allows the user to dispense a complete dose of product or a partial dose, as desired.

It may be noted that an intermediate position of the push button does not impede the screwing of the cap onto the reservoir. This is because, rather than being in abutment against the foot of the stops 16, the studs then bear against an intermediate zone of these stops in order to connect the insert 8 and the sleeve 10 in rotation.

Of course, numerous modifications can be made to the invention without departing from the scope thereof.

In particular, the piston and the push button could be produced in one piece. In addition, the cover and the screwing insert could be produced in one piece.

Also, it is possible to adapt to the viscosity of a product to be dispensed by altering the friction of the various parts. For example, for a low viscosity, or even liquid, product, it is possible to increase the friction, in particular the friction between the rod 20*a* and the pipette 4 in order for the product to be retained in the pipette when the cap is taken out of the reservoir. By contrast, for a product with high viscosity, it is possible to decrease the volume of air contained in the pipette by lengthening the rod 20*a*.

The invention claimed is:

1. A product dispenser, comprising:

a reservoir for a product, a closure cap configured to be screwed onto the reservoir, and a rigid piston configured to move so as to create a suction to draw the product through an orifice of a pipette of the product dispenser, wherein when the cap is screwed on the reservoir, a rotation of the cap with respect to the reservoir in a direction of opening of the product dispenser causes, by itself, the piston to move along a path producing the suction;

the piston being configured to dispense the product through the orifice of the pipette.

2. The dispenser of claim 1, wherein a push button is configured to emerge from the cap upon a rotation of the cap in an opening direction thereof.

3. The dispenser as claimed in claim 2, wherein the push button is configured to emerge and the cap is configured to contemporaneously remain unmoved upon the rotation of the cap in the opening direction thereof.

4. The dispenser as claimed in claim 2, wherein at an end of movement travel of the push button, the rotation of the cap causes the cap to be unscrewed without the piston moving with respect to the cap.

5. The dispenser as claimed in claim 2, wherein when the push button is in an at least partially depressed position with respect to the cap, the dispenser does not produce any force to cause the push button to leave the depressed position except when the cap is replaced on the reservoir.

6. The dispenser as claimed in claim 2, wherein when the push button is in an at least partially depressed position with respect to the cap, the dispenser does not produce any force to cause the push button to leave the depressed position except when unscrewing is carried out.

7. The dispenser as claimed in claim 2, wherein when the push button is in an at least partially depressed position with respect to the cap, the rotation of the cap in the direction of opening returns the piston to an end of a path thereof.

8. The dispenser as claimed in claim 1, further comprising at least one ramp and at least one cam, the cap being configured to guide the piston via the ramp and the cam.

9. The dispenser as claimed in claim 8, wherein the ramp and the cam are secured to the cap and the piston, respectively.

10. The dispenser as claimed in claim 8, further comprising a sleeve having a thread configured to screw the cap onto the reservoir, and a slot configured to receive the cam.

11. The dispenser as claimed in claim 8, further comprising at least one stop configured to connect the ramp and the cam in rotation.

12. The dispenser as claimed in claim 1, wherein the product has a viscosity between 10,000 and 35,000 centipoise.

13. A makeup or care device comprising the dispenser as claimed in claim 1, wherein the closure cap includes:

a screwing insert, and a sleeve, the closure cap being configured to move the piston via a rotation of the screwing insert with respect to the sleeve.

14. The product dispenser of claim 1, wherein the piston is caused to move along the path producing suction of the product without an urging mechanism.

15. A closure cap for a product reservoir, the closure cap comprising:

a screwing insert, a sleeve, and a rigid piston, the closure cap being configured such that a rotation of the screwing insert with respect to the sleeve causes, by itself, the piston to move and draw a product from the product reservoir through an orifice of a pipette of the closure cap, the piston being configured to dispense the product through the orifice of the pipette.

16. The closure cap of claim 15, wherein the closure cap includes embedded features configured to move the piston via a rotation of the screwing insert with respect to the sleeve.

17. The closure cap of claim 15, wherein the piston is caused to move without an urging mechanism.

18. A product dispenser, comprising:

a reservoir configured to house a product, a closure cap configured to be screwed onto the reservoir, and a rigid piston configured to move so as to create suction to draw the product through an orifice of a pipette of the product dispenser, wherein the closure cap is configured to move the piston along a path producing the suction by direct contact with the piston, the piston being configured to dispense the product through the orifice of the pipette.

19. The product dispenser of claim 18, wherein the closure cap includes embedded features configured to move the piston along a path producing the suction.

20. The product dispenser of claim 18, wherein the piston is caused to move without an urging mechanism.

* * * * *